United States Patent [19]

Braun

[11] 3,971,373

[45] July 27, 1976

[54] PARTICLE-LOADED MICROFIBER SHEET PRODUCT AND RESPIRATORS MADE THEREFROM

[75] Inventor: David L. Braun, Lake Elmo, Minn.

[73] Assignee: Minnesota Mining and Manufacturing Company, St. Paul, Minn.

[22] Filed: Dec. 6, 1974

[21] Appl. No.: 530,070

Related U.S. Application Data

[63] Continuation-in-part of Ser. No. 435,198, Jan. 21, 1974, abandoned.

[52] U.S. Cl. ..... 128/146.2; 428/328

[51] Int. Cl.[2] ..... A62B 23/02

[58] Field of Search ..... 128/140 R, 141, 142.6, 128/146.2, 146.6, 1; 428/242, 244, 296, 323, 328; 156/167, 170; 55/316

[56] References Cited

UNITED STATES PATENTS

| | | | |
|---|---|---|---|
| 3,368,326 | 2/1968 | Hervert | 55/316 |
| 3,620,214 | 11/1971 | Thackston | 128/146.2 |
| 3,801,400 | 4/1974 | Vogt et al. | 156/167 |

*Primary Examiner*—William E. Kamm

*Attorney, Agent, or Firm*—Alexander, Sell, Steldt & DeLaHunt

[57] ABSTRACT

A self-supporting durable flexible conformable low-pressure-drop porous sheet product that contains a uniform three-dimensional arrangement of discrete solid particles. This sheet product comprises, in addition to the particles, a web of melt-blown microfibers in which the particles are uniformly dispersed. The particles are physically held in the web, even though there is only point contact between the microfibers and the particles, whereby the full surface of the particles is available for interaction with a medium to which the sheet product is exposed. The sheet product is especially useful in respirators in which, for example, the sheet product is shaped as a cup-like member adapted to fit over the mouth and nose of a person.

24 Claims, 5 Drawing Figures

PARTICLE-LOADED MICROFIBER SHEET PRODUCT AND RESPIRATORS MADE THEREFROM

Reference to Related Application

This application is a continuation-in-part of pending application Ser. No. 435,198, filed Jan. 21, 1974, and now abandoned.

BACKGROUND OF THE INVENTION

The present invention arises from inadequacies in previous techniques for presenting a mass of discrete particles for interaction with a medium. A specific example of these inadequacies lies in the field of respirators. One presently commercial face mask for removing noxious vapors from the air comprises a porous nonwoven sheet in which alumina particles are dispersed (the alumina particles are cascaded into a fluffy nonwoven web of staple fibers prepared by "rando-webbing" or garnetting, and the web is then compressed and cut into sheets of the desired shape, whereupon the edges of the cut sheets heat-seal together). While the mask works effectively to remove the noxious vapors, the life of the mask is shorter than desired.

The short life of this face mask has been traced to difficulties in providing and maintaining a uniform distribution of particles. It is difficult to initially obtain a uniform distribution of particles by cascading them into a fluffy nonwoven web of staple fibers. More than that, it is believed that particles within the completed sheet migrate through the interstices of the fibrous web as a result of normal handling or vibration of the mask or as a result of air flow through the mask. The result is that thin spots develop in the array of particles. Eventually a "breakthrough" of noxious vapors occurs at the thin spot, and the effective life of the mask is ended. While the weight of alumina particles could be increased to lengthen the life of the mask, such a change would also increase the static pressure of the mask (that is, the pressure drop through the mask), whereupon breathing through the mask would be more difficult.

The described technique for supporting particles for interaction with a medium is just one of many that have been proposed or used, but generally all of the previous approaches require some unsatisfactory compromise in properties. Some require an undesirably high static pressure or pressure drop (as in packed beds of the particles, which otherwise have maximum exposed surface area, or as when particles are impregnated into or coated onto fibrous papers; see U.S. Pat. Nos. 328,947 and 3,158,532). Some require too many ingredients besides the particles themselves (such as binder materials, fiber sizing agents, or other additives), which limits the utility of the products because of chemical or other characteristics of the added ingredients (see U.S. Pat. Nos. 2,369,462 and 3,745,060). Some require covering part of the reactive surface of the particles and therefore lessening the efficiency of the particles, as when binder material is used to adhere the particles in place in a web or to themselves (see U.S. Pat. Nos. 3,801,400; 3,745,060; 3,615,995; 2,988,469; and 3,474,600). And some require elaborate and expensive supporting apparatus, as for packed beds of the particles or for certain mixtures of fibers and particles (see U.S. Pat. No. 3,083,157). While each of the described approaches has its own uses and advantages, their inadequacies, including those listed above, leads to a need for a new, superior technique for supporting a mass of particles.

SUMMARY OF THE INVENITON

The present invention provides a porous sheet product containing a novel supported three-dimensional arrangement of particles. This sheet product, in which essentially the full surface area of the particles is available for interaction with a medium to which the sheet product is exposed, comprises a web of melt-blown microfibers (very fine fibers prepared by extruding molten fiber-forming material through fine orifices in a die into a high-velocity gaseous stream) and the particles themselves. No additional binder material to adhere the particles to the fibers is necessary. Nor are particles adhered to the fibers by tackiness of the fibers.

In preparing a sheet product of the invention, particles are introduced into the gaseous stream carrying the microfibers and become intermixed with the microfibers. The mixing occurs at a location spaced from the die where the microfibers have become nontacky. The mixture is collected on a collection screen, with the microfibers forming a web and the particles becoming dispersed in the web.

The particles are held within the web despite the fact that the melt-blown microfibers have no more than point contact with the particles. ("Point contact" occurs when preformed bodies abut one another. It is distinguished from area contact, such as results when a liquid material is deposited against a substrate, flows over the substrate, and then hardens in place.) The full explanation for this holding action is not known. One factor is that the particles in a sheet product of the invention are usually large enough to be physically entrapped within the interstices of the web. Since microfiber webs have small interstices, and since particles are introduced into a web of the invention during formation of the web, the particles are usually well-entrapped by microfibers.

However, even particles not physically entrapped with the interstices of the web are physically held in the web. Apparently this holding occurs because of the unique nature of the melt-blown microfibers. Their fine size makes it possible for a limited volume of fiber material to have a vast number of point contacts with the particles. Further, the conformability of the microfibers encourages such contacts, which provide strong forces of surface attraction.

Whatever the explanation, amazing results are possible. Sheet products of the invention can be made in which well over 99 volume percent of the solids content of the web is particles (by "solids content" it is meant the portion of the web physically occupied by a tangible article, such as microfibers or particles, and it does not include empty space betwen particles or fibers). Despite high loadings, the sheet products have low pressure drops and other useful web properties including good durability. These properties adapt the sheet product to a wide variety of uses, including respirators of the type where a sheet product is shaped as a cup-like face mask adapted to fit over the nose and mouth of a person.

Others have proposed introducing particulate matter into a web of microfibers, but generally they have required that the fibers of the web be tacky so as to hold the particles in place (see U.S. Pat. Nos. 3,801,400;

3,615,995; and 2,988,469, mentioned above). Also, some have suggested addition of presumably small amounts of particles that modify properties of the microfiber webs (see R. R. Buntin and D. R. Lohkamp, "Melt-Blowing — A One-Step Web Process for New Nonwoven Products," TAPPI, Volume 56, No. 4, pp. 74–77, reportedly presented as a paper on Oct. 24–25, 1972, where it is briefly suggested that powders or sprays that cannot be extruded, such as flame retardants or wetting agents, be directly added at the time of web formation).

None of these prior-art teachings answers the need, as exemplified by the deficiencies of the prior-art respirators described above, for improved kinds of supported three-dimensional arrangements of particles. Until the present invention it had never been recognized, insofar as known, that large volumes of particles can be introduced in a lastingly uniform manner into a melt-blown microfiber web, without adhering the particles to the microfibers by use of a binder material or by use of tacky fibers; with hardly any increase in pressure drop as a result of the presence of the particles; and while maintaining other useful web properties. The uniformity of loading can be obtained even with small particles, which means large useful surface areas; and because of the lasting uniformity, even thin sheet products of the invention will have a long useful life.

The uniformity of the particle distribution is indicated by a test for removal of noxious vapors. ("Uniform," as used herein, means that adjacent cubic centimeters of continuous web have substantially the same number of particles and does not imply the precise regularity of a crystal structure.) For example, when a 171-square-centimeter sample of a sheet product that consists of a web containing 0.004 gram/square centimeter of melt-blown polypropylene microfibers that average 5 micrometers in diameter and alumina particles that average 120 micrometers in diameter, with the alumina particles accounting for about 25 volume-percent of the solids content of the web, is challenged by dry air at 16 liters per minute containing 33parts per million of hydrofluoric acid, there is less than a 5 ppm "breakthrough" of hydrofluroic acid until at least about 4 hours have passed. To attain a similar time until breakthrough using the commercial face mask described above, with its bed of alumina particles disposed inside a nonwoven sheet, would typically require more than a two-fold increase in the number of particles. That would increase the cost of the mask, make less efficient use of the particles, and increase the pressure drop through the mask. Such a uniformity in combination with the other useful properties of sheet products of the invention leads to a wide utility beyond air-purifying. Nothing in the prior art made possible the increased utility of supported three-dimensional arrangements of particles accomplished by the present invention.

DETAILED DESCRIPTION

Figure 1:
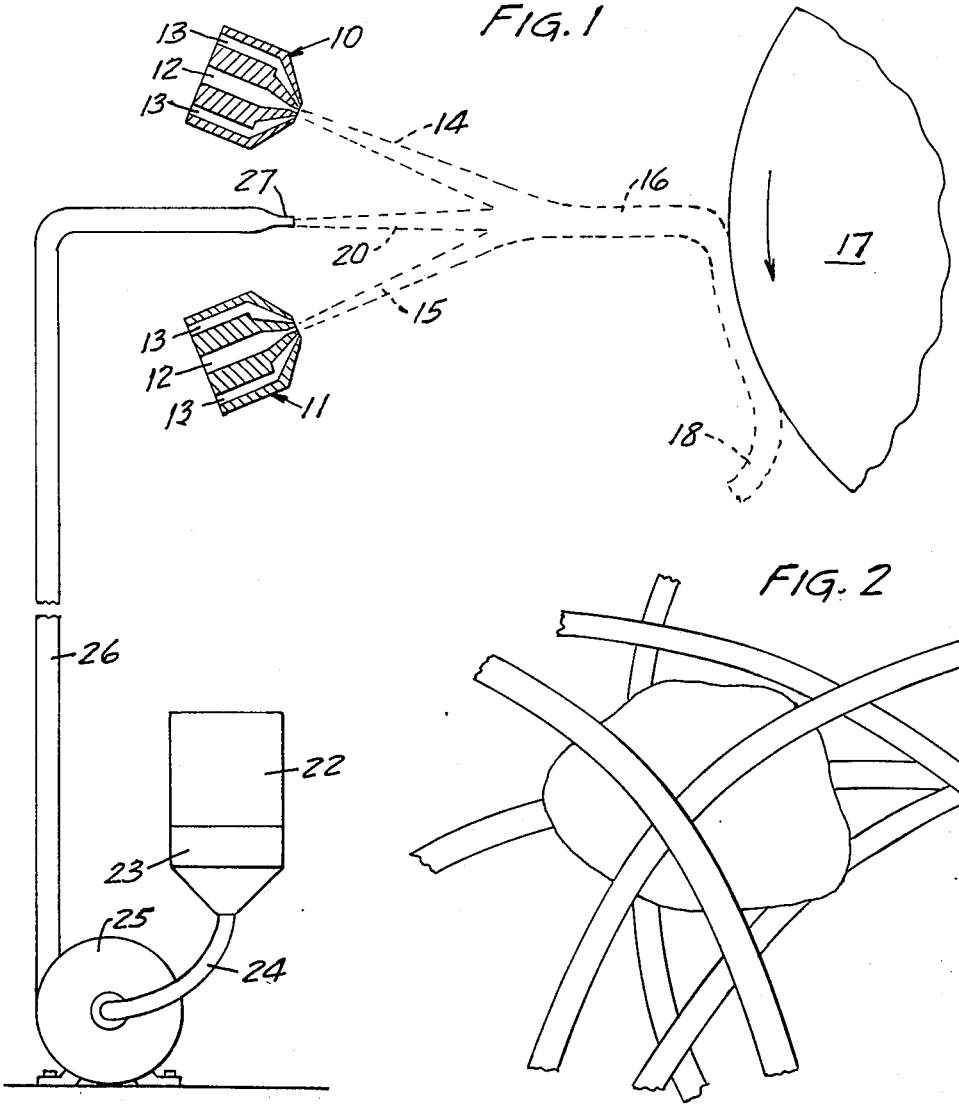
FIG. 1 is a schematic diagram of apparatus used in practicing the present invention.
Figure 2:
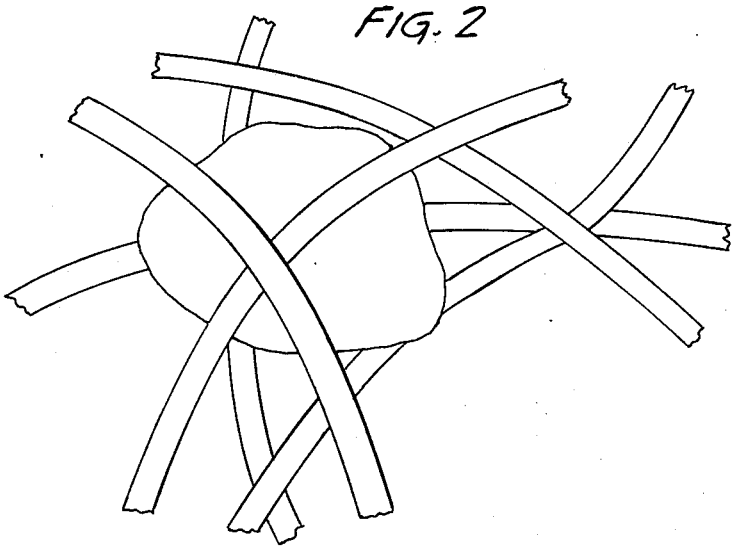
FIG. 2 is a greatly enlarged cross-sectional view of a portion of a sheet product of the invention.

Apparatus used in practicing the present invention is shown schematically in FIG. 1 and takes the general form of apparatus as described in Wente, Van A., "Superfine Thermoplastic Fibers" in *Industrial Engineering Chemistry*, Vol. 48, p. 1342 et seq (1956), or in Report No. 4364 of the Naval Research Laboratories, published May 25, 1954, entitled "Manufacture of Superfine Organic Fibers," by Wente, V. A.; Boone, C. D.; and Fluharty, E. L. The illustrated apparatus includes two dies 10 and 11 which include a set of aligned parallel die orifices 12 through which the molten polymer is extruded, and cooperating air orifices 13 through which heated air is forced at a very high velocity. The air draws out and attenuates the extruded polymeric material, and after a short travel in the gaseous stream, the extruded material solidifies as a mass of microfibers. According to the present invention, two dies are preferably used and arranged so that the streams 14 and 15 of microfibers issuing from them intersect to form one stream 16 that continues to a collector 17. The latter may take the form of a finely perforated cylindrical screen or drum, or a melting belt. The collected web 18 of microfibers is then removed from the collector and wound in a storage roll.

According to the invention a stream of particulate matter is introduced into the stream of microfibers prior to collection of the microfibers on the collector. Preferably a single stream 20 of particles is arranged between the two dies 10 and 11 as shown in FIG. 1, and the particle stream 20 intercepts the two streams of microfibers at the latter's point of intersection. Such an arrangement is believed to provide a maximum loading of particles into a microfiber web. Alternatively, a single die may be used with one or more particle streams arranged to intersect the stream of microfibers issuing from the die. The streams of microfibers and particulate matter may travel in horizontal paths as shown in FIG. 1, or they may travel vertically so as to generally parallel the force of gravity.

Once the particles have been intercepted in the microfiber streams, a process for making the sheet product of the invention is generally the same as the process for making other microfiber webs; and the collectors, methods of collecting, and methods of handling collected webs are generally the same as those used for making non-particle-loaded melt-blown microfiber webs. Maximum magnitudes and uniformity of loading are generally obtained by multilayer deposition techniques, especially when the layers are laterally displaced from one another. For example, in one practice of the invention, the dies 10 and 11 and the nozzle 27 are moved transversely across the width of a collecting drum so as to form a spiral or helical deposit on the drum. The transverse movement is sufficiently slow so that succeeding layers of fibers and particles deposited during different revolutions of the drum partially overlap one another.

The layer of fibers and particles formed in any one revolution, and a completed sheet product of the invention, may vary widely in thickness. For most uses of sheet products of the invention, a thickness between 0.05 and 3 centimeters is used. In respirators or face masks, the thickness is generally about 0.05 to 1.5 centimeters, and where especially low pressure drops are important, will preferably be less than about 0.3 centimeter. For certain applications, two or more separately formed particle-loaded webs may be assembled as one thicker sheet product of the invention.

In the embodiment illustrated in FIG. 1, the apparatus for feeding particles into the stream of microfibers comprises a hopper 22 for storing the particles; a metering device 23, such as a magnetic valve or metering device described in U.S. Pat. No. 3,661,302, which meters particles into a conduit 24 at a predetermined rate; an air impeller 25 which forces air through a second conduit 26 and which accordingly draws particles from the conduit 24 into the second conduit 26; and a nozzle 27 through which the particles are ejected as the particle stream 20. The nozzle 27 may be formed, for example, by flattening the end of a cylindrical tube to form a wide-mouthed thin orifice. The amount of particles in the particle stream 20 is controlled by the rate of air flow through the conduit 26 and by the rate of particles passed by the metering device 23.

The invention is useful generally to support any king of solid particle that may be dispersed in an air stream ("solid" particle, as used herein, refers to particles in which at least an exterior shell is solid, as distinguished from liquid or gaseous). A wide variety of particles have utility in a three-dimensional arrangement in which they can interact with (for example, chemically or physically react with, or physically contact and modify or be modified by) a medium to which the particles are exposed. More than one kind of particle is used in some sheet products of the invention, either in mixture or in different layers. Air-purifying devices such as respirators in which the particles are intended for filtering or purifying purposes constitute one large important utility for sheet products of the invention. Typical particles for use in filtering or purifying devices include activated carbon, alumina, sodium bicarbonate, and silver particles which remove a component from a fluid by adsorption, chemical reaction, or amalgamation; or such particulate catalytic agents as hopcalite, which catalyze the conversion of a hazardous gas to a harmless form, and thus remove the hazardous component. In other embodiments of the invention, the particles deliver rather than remove an ingredient with respect to the medium to which the particles are exposed.

The particles may vary in size, at least from 5 micrometers to 5 millimeters in average diameter; most often they are between 50 micrometers and 2 millimeters in average diameter. For respirators, the particles generally average less than one millimeter in diameter. When the average diameter of particles included in a sheet product of the invention is at least as large as the interstitial space between the microfibers in the microfiber web (which in a non-loaded web generally averages about 4 or 5 times the average diameter of the microfibers), the web is "opened" by the presence of the particles to have a greater volume between fibers. This opening creates a potential for more fiber-to-particle contacts so that a greater volume of particles can be included in the web. In addition, the fact that the particles are on the average as large as the interstitial spacing contributes to improved physical entrapment for the particles. In most webs of the invention, average diameter of the particles is at least 5 times the average diameter of the microfibers, and preferably it is at least 10 times the average diameter of the microfibers.

Fine particles, having an average diameter less than the average interstitial space between microfibers, and ultrafine particles, having an average diameter less than the average diameter of the microfibers, may also be loaded into sheet products of the invention. Smaller particles generally open a web into which they are loaded less than larger particles, and fine and ultrafine particles are generally included in a web at lower loadings than larger particles. Fine and ultrafine particles are sometimes included in batches of larger particles, either deliberately to obtain a desired blend of particle sizes or because they are carried on larger particles as a result of particle-to-particle interactions. In photomicrographs of some sheet products of the invention, ultrafine particles may be seen covering the microfibers. These particles adhere to the microfibers apparently through Van der Waal forces or the like. Upon tearing the sheet product apart and vigorously washing the fibers, the particles are removed. After removal, there are no indentations in the fibers, showing that particles were not wet by the fibers.

As previously noted, a significant advantage of the invention is the possibility of arranging rather small, high-surface-area particles in a useful array so as to obtain a high degree of reaction between particles and a fluid exposed to the particles. Generally a sheet product of the invention includes at least 2 square centimeters, and preferably at least 10 square centimeters, of surface area of particles per square centimeter of area of web and per centimeter of thickness of web. Besides increases in surface area because of small size, surface area may be high because of the use of porous or irregularly shaped particles; but the standards above apply only to surface area owing to small size (and are calculated assuming the particles are perfect spheres).

The microfibers in the web also vary in size, generally having an average diameter between about 1 micrometer and 25 micrometers, and preferably having an average diameter less than 10 micrometers. The lengths of the fibers also vary and they may have lengths of 10 centimeters or more. A variety of polymeric materials may be used, including polypropylene, polyethylene, polyamides, and other polymers taught in the blown microfiber art. Fibers of different polymers may be used in the same sheet product in some embodiments of the invention, either in mixture in one layer or in different layers. Also preformed staple fibers may be included in mixture with the blown microfibers. For most sheet products of the invention, the microfibers are substantially inert to the medium to which the particles are exposed, meaning that the only active ingredient is the particle. However, in some embodiments of the invention the microfibers have a function besides their physical support function, as a filter or sorbent, for example.

As previously noted, particles can be included in a sheet product of the invention in a rather high amount, accounting for at least 20 volume-percent of the solids content of the web, for example. For uses of the sheet product to purify air or another fluid, the particles may account for lower than 20 volume-percent of the solids content of the web. But usually in such sheet products, the particles will also account for 20 or more volume-percent, and preferably at least about 30 volume-percent, of the solids content of the web. For many uses higher loadings of particles, such as 50 volume-percent, are needed.

The unique nature of the particle-holding action in sheet products of the invention can be illustrated by considering the high loadings of particles that can be achieved. When 75 volume-percent of the web is particles, the volume of particles is three times as great as the volume of fibers; at 95 volume-percent, it is almost 20 times as great; at 99 volume-percent, it is almost 100 times as great; and at 99.5 volume-percent, it is almost 200 times as great. All of these loadings have been attained without any use of binder or adhesive material adhering the particles to the fibers and without any wetting of particles by molten or tacky fibers.

The fact that the pressure drop through a sheet product of the invention is not greatly higher than through a comparable nonloaded melt-blown microfiber web is another significant advantage ("comparable" in that it includes the same microfibers, collected under the same processing conditions, except that no particles are introduced into the particle delivery airstream). In many cases the pressure drop through a particle-loaded sheet product of the invention is less than through a comparable nonloaded melt-blown microfiber web, probably because of a slight opening of the web as a result of the presence of the particles. In other cases the pressure drop through a sheet product of the invention is somewhat greater than through a comparable melt-blown microfiber web, though generally it is no more than 200 percent, and preferably is no more than 125 percent, of the pressure drop through the comparable web.

Figure 4:
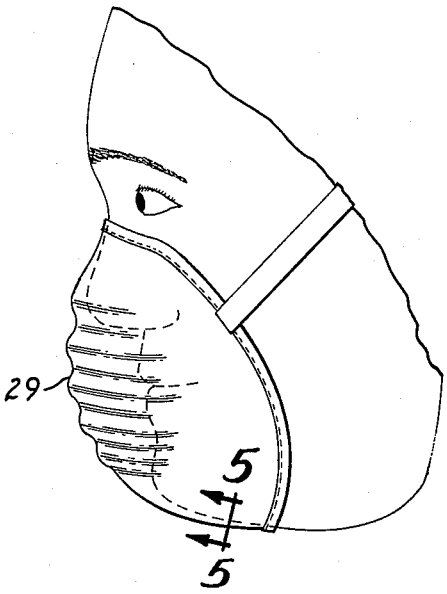
FIGS. 4 and 5 show one useful respirator of the invention, FIG. 4 being a perspective view and FIG. 5 being an enlarged sectional view taken along the lines 5—5 of FIG. 4.
Figure 5:
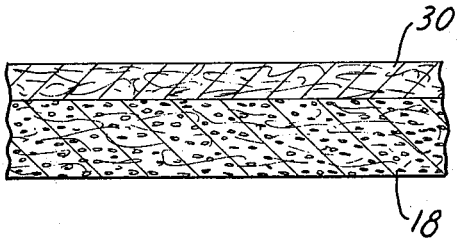

Sheet products of the invention may be incorporated into respirators in the same ways as conventional non-particle-loaded webs are included. In one convenient form, a sheet product of the invention is incorporated in a face mask of the general configuration taught in U.S. Pat. No. 3,333,585, generally together with a liner that lies between the sheet product of the invention and the wearer. FIGS. 4 and 5 of the drawings show such a face mask 29, which has a cup-like shape that adapts it to fit over the mouth and nose of a person. The sectional view of part of the mask presented in FIG. 5 shows a sheet product of the invention (such as 18 from FIG. 1) together with a liner 30 disposed over the sheet product.

The invention will be further illustrated by the following examples (all pressure drops reported in the examples were measured at a face velocity of 17 centimeters/second).

EXAMPLES 1–8

A series of sheet products of the invention were prepared using polypropylene microfibers that averaged about 5 micrometers in diameter and different sizes and different amounts of activated carbon particles. The sheet products were prepared with an apparatus as shown in FIG. 1, with the die orifices of the two dies being separated from one another by 6 inches (15 centimeters), the dies being arranged to project fiber streams at an angle of 20° to the horizontal, with the fiber streams intersecting at a point about 8 inches (20 centimeters) from the die orifices and continuing to a collector surface located 12 inches (30 centimeters) from the die orifices. Polymer was extruded through the die orifices at a rate of 0.4 pound per hour per inch (0.07 kilogram/hour/centimeter) width of die, and air heated to 780°F (415°C) was forced through the hot air orifices of the dies at a rate of 70 standard cubic feet (1980 liters) per minute.

Three different samples of activated carbon particles were used in the examples, one sample (Type A in the table below) being "Witco" Brand Grade 249 activated carbon particles selected by 80 and 400 mesh screens (U.S. Standard; 177 to 37 micrometers in diameter); Type B being "Witco" Brand Grade 235 activated carbon particles 50 by 140 mesh (297 to 105 micrometers in diameter) and Type C being "Witco" Brand Grade 360 activated carbon particles 8 by 30 mesh (2,000 to 595 micrometers in diameter). The carbon particles were fed uniformly to the air blower at rates up to 1 pound (0.45 kilogram) per minute. An air velocity through the supply conduit 26 of about 5,000 feet (1500 meters) per minute was used to give good particle/fiber mixing prior to collection.

Some illustrative characteristics of the different sheet products of the examples are given in Table I:

TABLE I

| Example No. | Weight of microfibers (milligrams/square cm.) | Amount of Carbon: Weight (milligrams/square cm). | Amount of Carbon: Volume percent of solids content of web (percent) | Pressure drop through sheet product (mm. of water) | Type of carbon |
|---|---|---|---|---|---|
| 1 | 6.13 | 0.32 | 2.5 | 10 | A |
| 2 | 6.13 | 1.61 | 11.7 | 10 | A |
| 3 | 6.13 | 2.58 | 14.9 | 10 | A |
| 4 | 6.13 | 3.87 | 24.2 | 10 | A |
| 5 | 6.13 | 6.13 | 33.5 | 10 | A |
| 6 | 6.13 | 23.9 | 66.3 | 13 | A |
| 7 | 6.13 | 43.5 | 78.2 | 10 | B |
| 8 | 6.13 | 77.4 | 86.5 | 8.5 | C |
| Comparative Example 1 | 6.13 | 0 | 0 | 12 | — |

As can be seen from the examples, sheet products of the invention can be made with very low loadings of particles, as well as with very high loadings. However, across this range of different loadings, the pressure drop of the particle-loaded sheet products of the invention remain very nearly equal to the pressure drop of the comparable nonloaded microfiber web.

Figure 3:
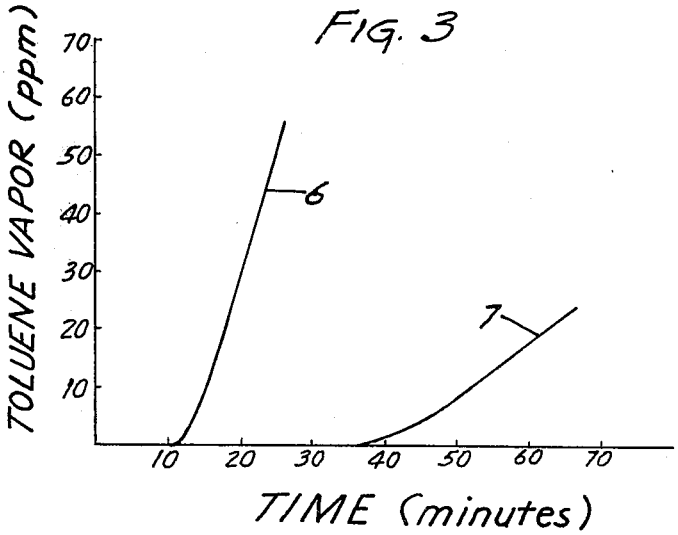
FIG. 3 is a graph showing the results of tests of sample sheet products of the invention, the units on the ordinate being parts per millions of toluene vapor and the units on the abscissa being minutes.

The above sheet products were tested for uniformity of carbon particle loading by challenging them with a flow of dry air (equal to 32 liters/minute per 81 square centimeters of area) containing an average concentration of 90 parts per million of toluene vapor and measuring the toluene concentration downstream from the sheet product with a flame ionization detector. The results are shown for two of the sheet products, Examples 6 and 7, in FIG. 3.

These graphs indicate that although the webs have only a small total weight of carbon (1.9 grams and 3.5 grams respectively for 81 square centimeters of sheet product), they completely remove the toluene vapor until a rapid breakthrough occurs. The steep slope of the curves illustrate the lack of "thin" spots in the web and indicate that substantially all the carbon is saturated prior to failure of the product.

EXAMPLES 9–10

A second series of sheet products of the invention were prepared using apparatus as described in Examples 1–8. Polymer was extruded through the die orifices at a rate of 0.6 pound/hour/inch (0.1 kilogram/hour/centimeter) of die width, and air heated to 820°F (440°C) was forced through the hot air orifices at a rate of 60 standard cubic feet (1700 liters) per minute. "Witco" Brand Grade 337 activated carbon, 50 by 140 mesh or 297–105 micrometers in diameter, was fed at different rates for the different examples, with a particle delivery air velocity of 18,000 feet (5400 meters) per minute. The microfibers prepared average 5 micrometers in diameter. The resultant sheet materials are summarized in Table II.

TABLE II

| Example No. | Weight of microfibers (milligrams/square cm.) | Amount of Carbon: Weight (milligrams/square cm.) | Amount of Carbon: Volume percent of solids content of web (percent) | Pressure drop through sheet product (mm. of water) |
|---|---|---|---|---|
| Comparative Example | | | | |
| 2 | 6.45 | 0 | 0 | 12 |
| 9 | 6.45 | 24.5 | 66 | 11.8 |
| 10 | 6.45 | 53.5 | 81 | 7.9 |

The sheet product of Example 9 was tested for capacity to sorb toluene vapor, using a flow of 14 liters/minute of dry air over an 81 square centimeter area with an average input concentration of 330 parts per million of toluene. At the start of the test, the filtered air contained 5 parts per million of toluene, which continued for the first 10 minutes of the test. Thereupon, the sheet product rapidly lost filtering capacity until, after 17 minutes, the filtered air contained 90 parts per million of toluene vapor.

EXAMPLES 11–14

A series of sheet products of the invention were prepared using the process variables of Examples 9 and 10, except that the hot air rate was reduced to 40 standard cubic feet (1130 liters) per minute, resulting in preparation of 10-micrometer-diameter microfibers. The same kind of carbon as used in Examples 9 and 10 was fed into the web at different rates to accomplish different loadings. The velocity of the particle delivery air stream was reduced to 8,000 feet (2400 meters) per minute.

Properties of the sheet materials are shown in Table III.

TABLE III

| Example No. | Weight of microfibers (milligrams/square cm.) | Amount of Carbon: Weight (milligrams/square cm.) | Amount of Carbon: Volume percent of solids content of web (percent) | Pressure drop through sheet product (mm. of water) |
|---|---|---|---|---|
| Comparative Example | | | | |
| 3 | 5.15 | 0 | 0 | 4.5 |
| 11 | 5.15 | 16.2 | 61.2 | 3.8 |
| 12 | 5.15 | 28.4 | 73.6 | 4. |
| Comparative Example | | | | |
| 4 | 3.87 | 0 | 0 | 2.5 |
| 13 | 3.87 | 30.3 | 79.8 | 3.5 |
| 14 | 3.87 | 22.6 | 74.7 | 3.0 |

The porosities and pore size distributions of the sheet products were measured by Mercury Intrusion Porosimetry. The results are listed in Table IV with additional data for the sheet products.

The table shows that the porosity of a sheet product decreases with increasing particle loading for the sheet products studied. Apparent density (that is, the weight of the web divided by its bulk volume) increases with particle loading, since the density of the carbon is approximately twice that of the polypropylene base web. From calculations made with respect to Example 13, it has been noted that the sheet product of that example approaches the characteristics of a bed of carbon particles. Apparently this similarity arises because the sheet product includes a lesser amount of microfibers, even though it contains the same ratio of particles to microfibers.

TABLE IV

| Example No. | Total Porosity (percent) | Apparent Density of Sheet Product (gram/cc) | Average Size: Pores of Sheet Product (micrometers) | Average Size: Fibers | Weights (milligrams square centimeter): Web | Weights (milligrams square centimeter): Carbon | Pressure Drop (millimeters of water) |
|---|---|---|---|---|---|---|---|
| Comparative Example | | | | | | | |
| 2 | 85.3 | 0.14 | 27 | 4.6 | 6.45 | 0 | 12 |
| 9 | 70.6 | 0.27 | 50 | 4.6 | 6.45 | 24.5 | 11.8 |
| 10 | 61.5 | 0.38 | 59 | 4.6 | 6.45 | 53.5 | 7.9 |
| Comparative Example | | | | | | | |
| 3 | 78 | 0.19 | 52 | 10 | 5.15 | 0 | 4.5 |
| 11 | 55.8 | 0.42 | 59 | 10 | 5.15 | 16.1 | 3.8 |
| Comparative Example | | | | | | | |
| 4 | 50 | 0.44 | 60 | 11 | 3.87 | 0 | 2.5 |
| 13 | 41 | 0.58 | 49 | 11 | 3.87 | 30.3 | 3.5 |

EXAMPLES 15–18

A further series of sheet products of the invention were prepared using samples of different sized particles. The apparatus and process variables were as described in Examples 11–14, except that the particle delivery system was set up for an arbitrary feed velocity of 5,000 feet (1500 meters) per minute, and rates of particle addition were varied. The microfibers prepared had an average diameter of 10 micrometers. "Witco" Brand Grade 337 activated carbon was obtained in a 12-by-20 mesh size and ground to three additional size distributions as follows:

| | |
|---|---|
| Type 1 | 12 by 20 mesh |
| Type 2 | 20 by 65 mesh |
| Type 3 | 65 by 150 mesh |
| Type 4 | 270 by 400 mesh |

Sheet products as described in Table V were made using the different types of carbon:

TABLE V

| Example No. | Weight of micro fibers (milligrams/square cm.) | Amount of Carbon: Weight (milligrams/square cm.) | Volume percent of solids content of web (percent) | Pressure drop through sheet product (mm. of water) | Type of carbon |
|---|---|---|---|---|---|
| 15 | 3.87 | 43.2 | 85 | 2.5 | 1 |
| 16 | 4.0 | 39.2 | 83.2 | 2.8 | 2 |
| 17 | 4.2 | 10.0 | 54.5 | 3.3 | 3 |
| 18 | 4.35 | 6.65 | 43.3 | 4.9 | 4 |
| Comparative Example 5 | 4.50 | 0 | 0 | 3 | — |

As is seen from these results, in general, the lower the size of the particles loaded into a web, the lower the amounts of the particles that may be loaded for the same size of fiber and same weight of fibers. The reported results are not the maximum loadings that could be accomplished with the described particles and fibers, however. The conditions for feeding particles into the web (such as the velocity of air through the supply conduit for the particles and the feed rate of the particles) should be optimized for each particle size.

The pressure drop for Example 18 is significantly higher than that of Comparative Example 5, probably due to the fact that the 270-by-400 mesh carbon (37–53 micrometers) is nearly equal to the web pore size and is plugging pores rather than opening them up.

When tested for absorption of toluene vapor, the sheet products of these examples gave similar results to those obtained in Example 9, taking into account the difference in the amount of carbon in the sheet product.

EXAMPLES 19–20

While the present invention is of special advantage in covering a given area with a thin, uniform, low-pressure-drop layer of particles, the invention is also useful in thicker layers. Seven layers of the sheet product of Example 13 were combined to give sheet product (Example 19) having a carbon weight of 0.215 gram/square centimeter and a pressure drop of 20.8 millimeters of water at a face velocity of 17.5 centimeters/second. (The increased carbon weights obtained by laminating these webs can also be obtained directly by fabricating thicker sheets in the formation process.) As a second example, four layers of Example 15 and two layers of Example 13 sheet product were combined to give a sheet product (Example 20) having a carbon weight of 0.235 gram/square centimeter and a pressure drop of 14 millimeters of water at the same velocity. The results of tests, which challenged the composite sheet products with an air flow of 14 liters/minute over an 81 square centimeter area, the air flow containing 250 parts per million of toluene in Example 19 and 350 parts per million of toluene in Example 20, are summarized in Table VI.

TABLE VI

| Example No. | 19 | 20 |
|---|---|---|
| Time (minute) | Downstream concentration (parts per million) | |
| 0 | 0 | 0 |
| 50 | 0 | 0 |
| 100 | 0 | 0 |
| 110 | 2 | 5 |
| 120 | 8 | 10 |
| 130 | 25 | 20 |
| 140 | 55 | 32 |

The above performance data compare quite favorably to a packed bed of carbon, but the sheet products of the invention have a significantly lower pressure drop than a packed bed. Sheet products of the invention are readily adaptable to other techniques for increasing the exposed surface area and weight of reactive particulate per unit of cross-sectional area, such as by folding the sheet products in accordion fashion.

EXAMPLE 21

A comparison of particle size distribution was made between the 50 by 140 mesh carbon starting material used in Example 10 (that is, carbon placed into the hopper 22) and the carbon which was removed from a sample of the completed sheet product. The carbon was removed from the sheet product by tearing the web apart, washing it and exposing the web to an ultrasonic bath in a water bath with wetting agent. Both distributions of particles were determined by a random count using a light microscope. The results are in Table VII.

TABLE VII

| Percentage of Particles That Are Greater Than Size Listed (percent) | Particle size (micrometers): From Web | Starting material |
|---|---|---|
| 5 | 235 | 248 |
| 10 | 215 | 230 |
| 20 | 188 | 203 |
| 30 | 170 | 188 |
| 40 | 160 | 175 |
| 50 | 148 | 159 |
| 60 | 135 | 140 |
| 70 | 121 | 128 |
| 80 | 108 | 110 |
| 90 | 85 | 85 |
| 95 | 30 | 20 |

EXAMPLE 22

Strip tensile strengths were measured for the sheet products of some examples and compared to the tensile strengths of the comparative web of nonloaded microfibers. Results are in Table VIII.

TABLE VIII

| Example No. | Tensile strength pound inch (kg/cm) of width | Weight-Ratio of Carbon to Fibers |
|---|---|---|
| Comparative Example 2 | 5.5 (1) | — |
| 9 | 5.2 (0.9) | 3.8:1 |
| Comparative Example 4 | 2.8 (0.5) | — |
| 13 | 2.1 (0.36) | 8:1 |
| 15 | 2.4 (0.44) | 11:1 |

TABLE VIII-continued

| Example No. | Tensile strength pound inch (kg/cm) of width | Weight-Ratio of Carbon to Fibers |
|---|---|---|
| Comparative Example 5 | 2.8 (0.5) | — |

The data shows that there is less than a 25 percent decrease in strip tensile strength even for the webs that are over 90 percent particulate by final weight.

EXAMPLE 23

Several layers of sheet product of the invention as prepared in the manner described in Example 13 were layered together to form a thicker sheet product of the invention, and that thicker product was compared with beds of carbon packed into a cannister that contained the identical kind and amount of carbon as used in the sheet product. The particles were 50 by 140 mesh (297 to 105 micrometers in diameter), the beds were 0.75 centimeter thick, the composite sheet product was 1.75 centimeters thick, both the beds and sheet product had a face area of 81 square centimeters, and both the beds and sheet product contained 25.5 grams of activated carbon.

It is difficult to produce and retain such thin beds, and the examples illustrate the superiority of sheet products of the invention to such beds. The first two attempts to test such a thin bed of carbon failed because the beds immediately passed high percentages of the toluene vapor applied to them. Presumably the early failure occurred as a result of shifting of the particles in the bed during both attempts, and, at least as to the first attempt, in which the bed was compressed between two layers of sponge rubber, by migration of the particles into the sponge rubber (in the second and third attempts, mats of blown microfiber were placed between the layers of sponge rubber and the bed). In the third attempt the bed was not moved after manufacture.

The beds and sheet product were challenged with 32 liters per minute of dry air containing about 400 parts per million of toluene vapor. In the third attempt, the bed passed about 1 or 2 parts per million of toluene through the first 40 minutes of the test, whereupon there was rapid decay to 10 parts per million at 70 minutes, 30 parts at 90 minutes, and 65 parts at 100 minutes. The sheet product of the invention passed essentially no toluene through the first 70 minutes of the test, 8 parts after 87 minutes, and 60 parts 100 minutes. The pressure drops across each of the three packed beds at a flow rate of 42 liters per minute were over twice the pressure drop through the sheet product of the invention.

EXAMPLES 24–28

A sheet product of the invention containing 100-by-400-mesh alumina particles was compared as to ability to remove hydrogen fluoride vapor with a prior-art nonwoven sheet containing the same alumina particles. The nonwoven web contained a mixture of 16-, 8-, and 6-denier polyethylene terephthalate fibers; the alumina was cascaded into the fluffy web after "rando webbing" of the fibers; and the web was then compressed and the edges heated sealed. The sheet product of the invention was prepared with apparatus generally as shown in FIG. 1, except that only one die was used. The nonwoven polyester web contained 0.008 gram/square centimeter of particles, while the sheet product of this invention contained only 0.004 gram/square centimeter.

Samples of both the polyester web and the sheet product of this invention having a face area of 171 square centimeters were challenged with 16 liters per minute of dry air containing a concentration of hydrogen fluoride vapor as given in the table below. Concentrations upstream and downstream of the sample were measured by bubbling a portion of the airstream through water and measuring the change in hydrogen fluoride concentration with a specific ion electrode for $F^-$. At low concentrations (less than 100 parts per million) the output voltage from the specific ion electrode is directly proportional to concentration. Tests were concluded when the downstream concentration exceed 5 parts per million. Results obtained are in Table IX.

TABLE IX

| Example No. | Average Input Concentration of hydrogen fluoride (PPM) | Time until Failure (hours) | PPM × Hours |
|---|---|---|---|
| 24 | 17.5 | 7 | 122.5 |
| 25 | 17.5 | 7 | 122.5 |
| 26 | 22.4 | 4.5 | 100.8 |
| 27 | 22.4 | 4.5 | 100.8 |
| 28 | 33.1 | 4.25 | 140.7 |
| Prior art polyester webs: | | | |
| A | 32.4 | 1.5 | 48.6 |
| B | 32.4 | 1.75 | 56.7 |
| C | 31.2 | 1.75 | 54.6 |
| D | 31.2 | 2.25 | 70.2 |

An alumina-filled sheet product of the invention as described in this example was fabricated into a respirator and tested against hydrogen fluoride vapor. The respirator effectively reduced the concentration of hydrogen fluoride in the inspired air to a physiologically safe level.

EXAMPLE 29

A sheet product of the invention (as described in Example 16) was compared with a commercial carbon-impregnated paper (containing 55 percent by weight carbon of about 350 mesh (40 micrometer) average size dispersed in wet-laid paper and viscose fibers. Samples of each (having an area of 81 square centimeters) were tested for pressure drop (using a face velocity of 17.5 centimeters/second) and for efficiency in removing toluene vapor (using dry air at 14 liters per minute containing an average of 40 ppm of toluene vapor for the paper and an average of 360 ppm for the sheet product of the invention). Results are in Table X.

TABLE X

| Example No. | Loading (milligrams/ square centimeter) | Pressure Drop (mm water) | Toluene vapor (in ppm) passed at different time intervals in minutes 1 | 3 | 4 | 10 | 15 | 20 |
|---|---|---|---|---|---|---|---|---|
| Paper | 14 | 30 | 25 | 100 | 250 | — | — | — |
| 7 | 38.8 | 10.5 | 0 | 0 | 0 | 30 | 100 | 200 |

EXAMPLES 30–34

A series of sheet products of the invention were prepared using polypropylene microfibers averaging about 5 micrometers in diameter and activated carbon particles selected with 12- and 20-mesh screens (800 to 1500 mirometers in diameter). Apparatus similar to that shown in FIG. 1 was used except that the dies and a particle feeder were mounted above the collector surface so that the particles dropped vertically onto the collector surface. The two dies were separated from one another by 6 inches (15 centimeters) and projected fiber streams which intersected at an angle of approximately 45° and a distance approximately 8 inches (20 centimeters) from the die orifice. The combined fiber and particle stream continued to a moving collector positioned 12 inches (30 centimeters) from the die orifices. Polymer was extruded at a rate of about 1.2 grams/minute/centimeter width of die and air heated to 950°F (510°C) was forced through the air orifices at a rate of 80 standard cubic feet (2250 liters) per minute. The carbon particles were fed to the mixing zone at rates varying from about 100 to 300 grams/minute/centimeter width of die. The collector speed was 23 feet (7 meters per minute for Examples 30 and 31 and 29 feet (9 meters) per minute for Examples 32–34. Bulky self-supporting sheet products were prepared which were loaded with from 98 volume-percent to over 99 volume-percent of particles; see Table XI. While severe handling of the sheet products would dislodge some particles from the sides of the web, the sheet products provided a useful support for particles.

EXAMPLES 35–38

A series of sheet products comprising polypropylene microfibers and polypropylene pellets were prepared with apparatus and conditions as described in Examples 30–34, (collector speed was 7 meters per minute for Examples 35 and 36 and 9 meters per minute for Examples 37 and 38). The polypropylene pellets had a somewhat flattened cylindrical shape and were on the order of 0.2 centimeter long, 0.3 centimeter wide, and 0.2 centimeter thick. The pellets were fed at rates varying from 200 to 300 grams/minute/centimeter width of die. Handleable self-supporting webs were obtained having compositions as described in Table XII.

TABLE XI

| Example No. | Weight of microfibers (milligrams/ square centimeter) | Weight (milligrams/ square centimeter) | Carbon Volume percent of solids content of web (percent) | Volume ratio of carbon to microfibers |
|---|---|---|---|---|
| 30 | 1.9 | 380 | 99 | 111 |
| 31 | 1.9 | 146 | 97.5 | 43 |
| 32 | 1.4 | 298 | 99.1 | 118 |
| 33 | 1.4 | 197 | 98.6 | 78 |
| 34 | 1.4 | 135 | 98.0 | 53 |

TABLE XII

| Example No. | Weight of Microfibers (milligrams/ square centimeters) | Weight (milligrams/ square centimeter) | Particles Volume percent of solids content of web (percent) | Volume ratio of particles to microfibers |
|---|---|---|---|---|
| 35 | 1.8 | 481 | 99.6 | 267 |
| 36 | 1.8 | 426 | 99.5 | 237 |
| 37 | 1.36 | 364 | 99.6 | 268 |
| 38 | 1.36 | 339 | 99.5 | 249 |

What is claimed is:

1. A self-supporting durable flexible conformable porous sheet product comprising a web of entangled melt-blown organic polymeric microfibers and a three-dimensional array of solid particles uniformly dispersed and physically held in the web, the only contact between the microfibers and particles being the point contact of preformed solid bodies whereby essentially the full surface of the particles is exposed for interaction with a medium to which the sheet product is exposed; and the particles comprising at least 20 volume-percent of the solids content of the web.

2. A sheet product of claim 1 in which said particles include particles for removing a predetermined component of a fluid that may be passed through the sheet product.

3. An air-purifying device comprising the sheet product of claim 2.

4. A respirator comprising the sheet product of claim 2 shaped as a cup-like member adapted to fit over the mouth and nose of a person wearing the respirator 5. A sheet product of claim 2 in which the particles comprise alumina particles.

6. A sheet product of claim 2 in which the particles comprise activated carbon particles.

7. A sheet product of claim 1 which consists essentially of only said web of microfibers and said particles.

8. A sheet product of claim 1 in which the web of blown microfibers includes fibers of more than one chemical composition.

9. A sheet product of claim 1 in which said particles include particles of two or more chemical compositions.

10. A sheet product of claim 1 in which the particles comprise at least 75 volume-percent of the solids content of the web.

11. A sheet product of claim 1 in which the particles comprise at least 90 volume-percent of the solids content of the web.

12. A sheet product of claim 1 in which the ratio of the average diameter of the particles to the average diameter of the microfibers is at least 5 to 1.

13. A self-supporting durable flexible conformable low-pressure-drop porous sheet product consisting essentially of a web of entangled melt-blown organic polymeric microfibers and a three-dimensional array of solid particles uniformly dispersed and physically held in the web; the average diameter of the particles being between 50 micrometers and 2 millimeters; the average diameter of the microfibers being less than 10 micrometers; and the ratio of the average diameter of the particles to the average diameter of the microfibers being at least 10 to 1; the particles comprising at least 20 volume-percent of the solids content of the web; and the only contact between the microfibers and particles being the point contact of preformed solid bodies, whereby essentially the full surface of the particles is exposed for interaction with a medium to which the sheet product is exposed; and whereby the pressure drop through the web is no more than 125 percent of the pressure drop through a blown microfiber web of the same microfibers without the particles and is less (as measured in the manner described herein) than the pressure drop through a uniformly packed bed that (a) consists of the same kind of particles as included in the sheet product, and (b) includes the same number of said particles per unit of face area as the sheet product includes.

14. A sheet product of claim 13 in which said particles include particles for removing a predetermined component of a fluid that is passed through the sheet product.

15. An air-purifying device comprising the sheet product of claim 14.

16. A respirator comprising the sheet product of claim 13 shaped as a cup-like member adapted to fit over the mouth and nose of a person wearing the respirator.

17. A sheet product of claim 13 in which the web of blown microfibers includes fibers of more than one chemical composition.

18. A sheet product of claim 13 in which said particles include particles of two or more chemical compositions.

19. A sheet product of claim 13 in which the particles comprise at least 75 volume-percent of the solids content of the web.

20. A sheet product of claim 13 in which the particles comprise at least 90 volume-percent of the solids content of the web.

21. A respirator comprising inlet structure defining a path of air intake from the ambient environment to the mouth and nose of a person wearing the respirator, support structure for mounting the respirator on a person wearing the respirator, and a porous sheet product disposed across the path of air intake so as to filter air drawn into the respirator, said sheet product comprising a web of entangled melt-blown organic polymeric microfibers and a three-dimensional array of solid particles dispersed and physically held in the web, the only contact between the microfibers and particles being the point contact of preformed solid bodies, whereby essentially the full surface of particles is exposed for interaction with a fluid passing through the sheet product.

22. A respirator of claim 21 in which the particles are alumina particles.

23. A respirator of claim 21 in which the particles are activated carbon particles.

24. A respirator of claim 21 in which said sheet product is shaped as a cup-like member adapted to fit over the mouth and nose of a person wearing the respirator.

* * * * *